US005496625A

United States Patent [19]

Lilani

[11] Patent Number: 5,496,625

[45] Date of Patent: Mar. 5, 1996

[54] MELAMINE THERMAL PROTECTIVE FABRIC AND CORE-SPUN HEAT RESISTANT YARN FOR MAKING THE SAME

[75] Inventor: Harish N. Lilani, Norristown, Pa.

[73] Assignee: Norfab Corporation, Norristown, Pa.

[21] Appl. No.: 366,854

[22] Filed: Dec. 30, 1994

[51] Int. Cl.[6] ..... D02G 3/02; D03D 3/00; B32B 7/00

[52] U.S. Cl. ..... 428/229; 57/210; 57/224; 57/229; 428/257; 428/263; 428/377

[58] Field of Search ..... 57/210, 224, 229; 428/257, 263, 377

[56] References Cited

U.S. PATENT DOCUMENTS

| | | | |
|---|---|---|---|
| 4,088,620 | 5/1978 | Nihongi et al. | 260/29.4 UA |
| 4,668,785 | 5/1987 | Ebel et al. | 544/196 |
| 4,886,882 | 12/1989 | Ebel et al. | 544/196 |
| 4,996,289 | 2/1991 | Berbner et al. | 528/230 |
| 5,084,488 | 1/1992 | Weiser et al. | 521/187 |
| 5,322,915 | 6/1994 | Weiser et al. | 528/163 |
| 5,356,938 | 10/1994 | Weiser et al. | 521/40 |

FOREIGN PATENT DOCUMENTS

| | | | |
|---|---|---|---|
| 4123050 | 7/1991 | Germany | C08G 14/10 |

*Primary Examiner*—James D. Withers
*Attorney, Agent, or Firm*—Volpe and Koenig

[57] ABSTRACT

A heat resistant woven fabric with an optional aluminized backing is disclosed. The fabric is particularly suited for heat resistant garments intended to resist radiant heat and heavy molten metal splashes in the temperature range of 2700°–3000° F. The preferred fabric has core-spun yarns with a flame and high heat resistant filament core covered by a layer of flame retardant fibers consisting of at least 35% melamine.

6 Claims, 4 Drawing Sheets

MELAMINE THERMAL PROTECTIVE FABRIC AND CORE-SPUN HEAT RESISTANT YARN FOR MAKING THE SAME

BACKGROUND OF THE INVENTION

1. Field of the Invention

This invention generally relates to heat resistant fabrics and yarn for making the same. More specifically, this invention relates to a heat resistent cost effective yarn and fabrics made therefrom which are suitable for use as primary clothing in heavy molten metal splash applications.

2. Prior Art

It has heretofore been common practice to make heat resistant fabrics from yarns of asbestos fibers or synthetic fibers that have high heat resistance. The high heat resistant asbestos fiber offered one of the highest level of resistance to molten metal splashes, however, the use of asbestos fibers has been considered hazardous to the user as well as other persons exposed to the fibers. As a result, synthetic fibers have found increasing use. The asbestos substitute fabrics are suitable for some molten metal splash applications. However, these prior synthetic attempts did not offer the thermal protection or the cost effectiveness of the present invention.

In the metals industry, workers are routinely exposed to heavy molten metal splashes. It is a common practice to wear flame resistant (FR) primary garments for protection. Generally, the primary garments are worn over secondary garments, such as typical work clothing. Primary garments are heavy fabric and sometimes laminated with an aluminum film on one side.

In the aluminum industry, the primary garments are made from FR treated wool, FR cotton and PVA fibers. Since molten aluminum does not radiate a large amount of heat, these garments are not generally laminated. The fabric weight varies between 10 to 20 oz/yd$^2$. In addition to the above, a variety of high heat and flame resistant synthetic fibers such as aramids, PBI, PAN based carbon and phenolic fibers have been tried individually and in various combinations. Due to the nature of molten aluminum—mainly its ductility and high temperature—these products have failed to meet the industry's requirements. The temperature of molten aluminum is approximately 1400°–1500° F. When molten aluminum is splashed onto primary garment fabric, it has a tendency to rapidly solidify on the fabric surface. Therefore, it is imperative that the surface of the primary garment provide thermal protection. FR treated wool, FR cotton and PVA fibers offer the required properties. Although, fibers like PBI, aramids and phenolic are high heat and flame resistant fibers that offer high limiting oxygen index (LOI) values from 40–30 LOI, fabrics made from these fibers (either individually or in combination), do not offer the desired thermal protection against molten aluminum splashes. The reason being the fiber's inability to take spontaneous thermal shocks arising from the impact of molten aluminum. For example, molten aluminum sticks to the aramid fabric thus resulting into a much higher heat transfer through the fabric. Aramid fabrics are widely used for fire fighters' turnout coats for open-flame exposure, however, the same type of fabric fails in a molten aluminum splash application.

Similarly, in the steel industry, which has the hazard of heavy molten steel (molten iron is generally in the temperature range of 2700°–3000° F.) splash, the substrate fabrics for the primary garments are made from fibers such as PAN based carbon, Kevlar and FR wool. Generally, these steel industry fabrics are laminated with an aluminum film. The aluminum film provides heat reflectivity qualities which are considered essential for protecting the wearer from the heavy doses of radiant heat emitting from molten steel and high temperature furnaces used in the manufacture of steel. The thermal impact of a molten iron splash requires the substrate fabrics to provide a significant amount of thermal protection. For example, 14 to 19 oz/yd$^2$ substrate fabrics laminated with aluminum film (on one side) and made from FR cotton, FR acrylic, FR rayon, Nomex and PBI fibers (either alone or blended), exhibit very poor performance against heavy molten iron splashes. In fact, some of these fabrics permit heat transfer that can cause second and third degree burns, and, in spite of being flame resistant fabrics, may ignite upon spontaneous impact of the molten iron. On the other hand, substrate fabrics of similar weight made from FR wool, PAN based carbon and/or Kevlar®, provide better protection against minor molten iron splash. However, with a major molten iron splash, these later fabrics offer very limited or no protection.

As can be seen from the above, the art desires a yarn and fabrics which are usable in heavy molten metal splash applications at a cost effective level.

The fabric of the invention employs known techniques of manufacturing a core-spun yarn with a novel fiber mix and distribution of fibers as a means to optimize cost and performance in heavy molten metal splash applications.

It is the principal object of the invention to provide a fabric for primary protective clothing which is cost effective, resistant to high temperatures, thermal shocks and suitable for application against heavy molten metal splashes.

Other objects and advantageous features of the invention will be apparent from the description and claims.

SUMMARY OF THE INVENTION

In accordance with the invention, a suitable fabric is provided for primary protective garments or clothing which are to provide primary protection against heavy molten metal splashes. The yarns for the construction of this fabric are made using core-spun yarns having a high temperature and flame resistant central core component covered with flame retardant melamine fibers. In the preferred embodiment, the woven fabric is laminated with a protective metallic film.

BRIEF DESCRIPTION OF THE DRAWINGS

The nature and characteristic features of the invention will be more readily understood from the following description taken in connection with the accompanying drawings forming part hereof.

Like numerals refer to like elements throughout the several view. It should, of course, be understood that the description and drawings herein are illustrative of the invention and that various modifications and changes can be made in the structure disclosed without departing from the spirit of the invention.

DESCRIPTION OF THE PREFERRED EMBODIMENTS

Melamine fibers are available from the BASF Company, of Ludwigshafen, W. Germany under the trade name of BASOFIL. Melamine fiber is very brittle and can not be spun into yarn that is processable on standard textile machinery. In addition, the melamine fiber can not be manufactured in a constant staple length. The variations in the fiber length and the brittleness of the fiber require that carrier fibers be used when melamine fibers are made into yarns.

Figure 1:
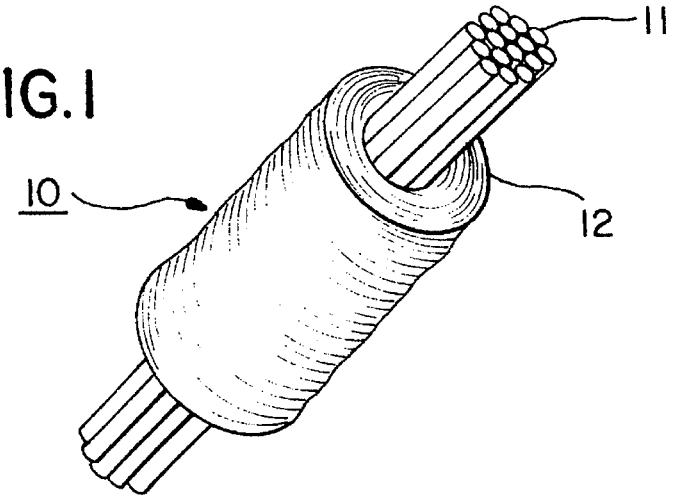
FIG. 1 illustrates a yarn in accordance with the invention.

The preferred fabric of the invention employs a composite yarn having a wrapper blend of 70% melamine fiber, 20% Kevlar and 10% carbon fibers over a filament fiberglass core that represents 40% to 50% of the yarn weight. Using the Dref-II core spinning process, single yarns of 83 tex and 130 tex were produced. As shown in FIG. 1, each yarn 10 has a core 11 and a wrapper 12. The single yarns were then plied. The plied yarn was then subsequently used to produce 11 oz/yd$^2$, ⅓ twill herringbone, 11 oz/yd$^2$, 2/2 twill herringbone and 17 oz/yd$^2$ 2/2 twill herringbone fabrics. The woven fabrics were then subsequently laminated with an aluminum film. The aluminized fabrics were tested for their molten iron splash resistance according to the applicable ASTM standard.

Figure 2:
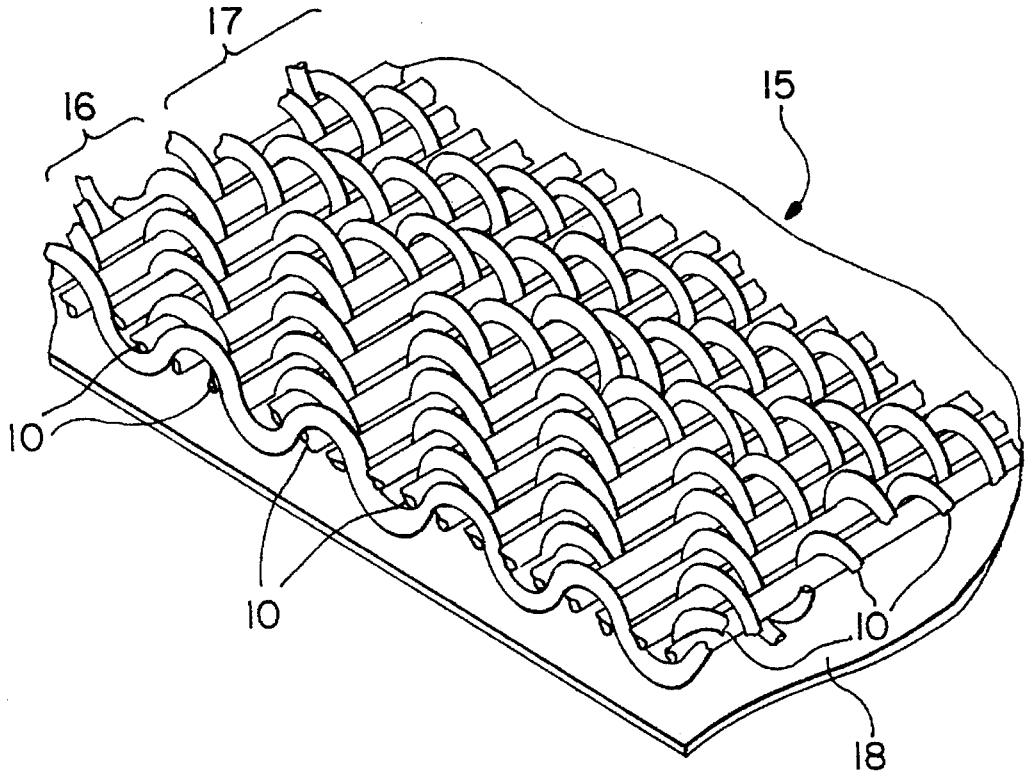
FIG. 2 illustrates a suitable fabric made from the yarn of the invention.

Referring now to FIG. 2 one suitable textile fabric 15 is illustrated. The textile fabric 15 as shown is a herringbone weave with both warp and filling threads of the yarns 10 heretofore described. The warp threads and filling threads may be of single or plied construction. The weave may be of any desired pattern providing a stable textile fabric. As illustrated, the weave comprises unitary bands 16 and 17 of two up, two down herringbone twill (2/2 twill herringbone), each of a width of approximately one half inch. The weight of the textile fabric may be varied per square yard with the preferred fabrics weighing approximately 11 to 17 oz/yd$^2$. The fabric 15 can be made into primary protective clothing for applications in heavy molten metal splash applications. The textile fabric 15 has high heat and abrasion resistance, and resistance to thermal shock attendant upon heavy molten metal splash. As also shown in FIG. 2, a metallic lamination 18, preferably of aluminum foil or film, can be provided to increase heat reflection and further enhance the qualities of the fabric.

The standardized conditions for molten iron impact evaluations consist of pouring 2.2 pounds of iron at a temperature of approximately 2750° F. onto fabric samples attached to a calorimeter board. The calorimeter board was oriented at an angle of 70° from the horizontal, then the metal was poured from a height of twelve inches onto fabric samples placed over the top calorimeter. The crucible containing the molten metal was rotated against a rigid stop and the metal dumped onto the test fabric. The splash duration, as determined with an infrared sensor pointed at the metal impact point, was about 1 to 1.1 seconds.

Figure 3:
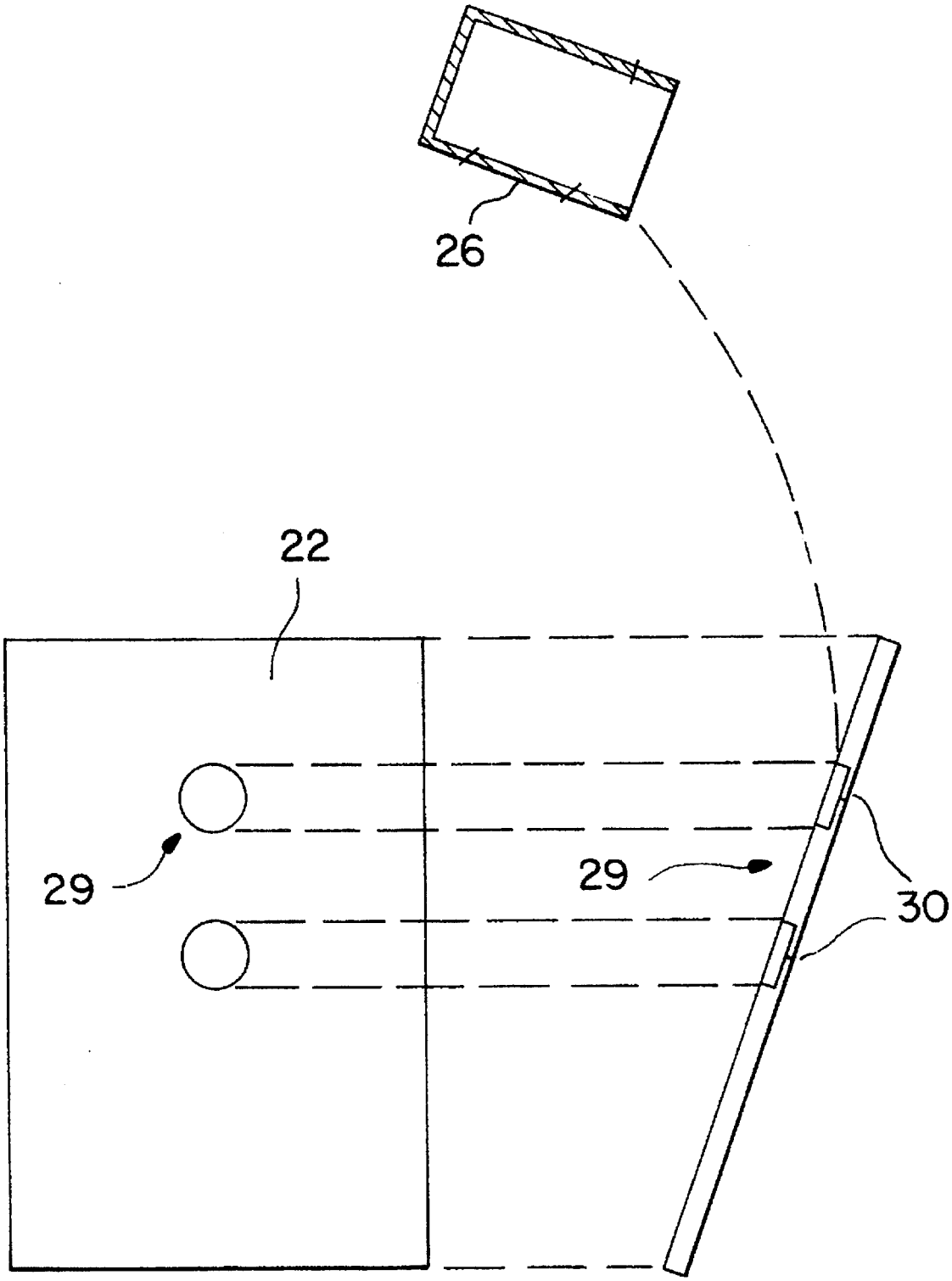
FIG. 3 illustrates the test apparatus for molten metal splash.
Figure 4:
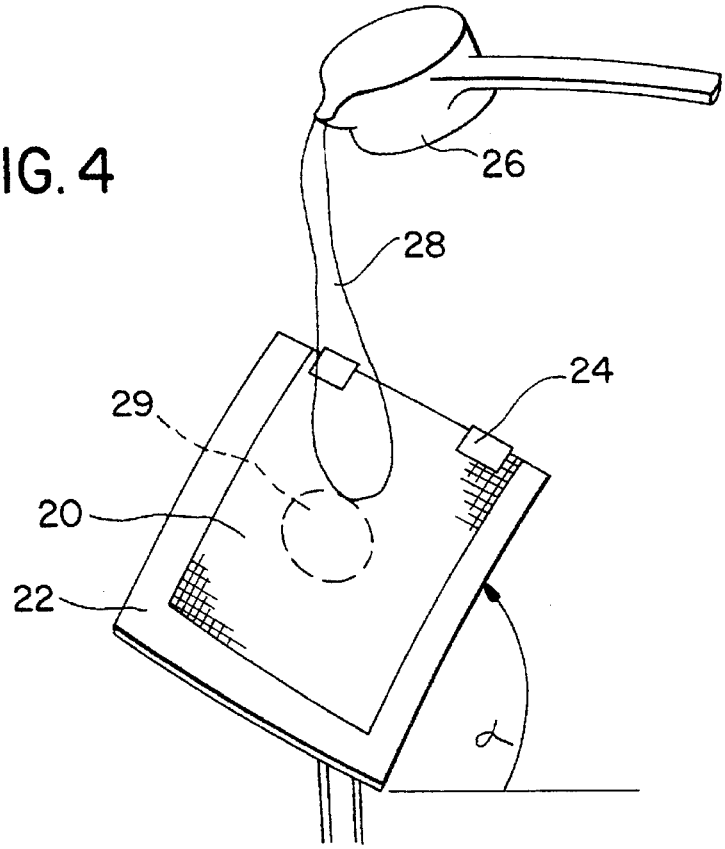
FIG. 4 illustrates a test pour.

The orientation of the ladle, sensor transite board, and calorimeters is schematically illustrated in FIGS. 3 and 4. The fabrics were also evaluated in the manner stated above using 3.3 pounds of molten iron at approximately 2750° F.

Each fabric was placed on the calorimeter or transite board 22 and held in place with clips 24 along the upper edge. A preheated ladle 26 was filled with molten iron from an induction furnace held at a temperature of approximately 2825° F. The metal weight in the crucible was measured using a spring balance and was maintained at 2.2 lb±4 oz when testing the first six fabrics. The same fabrics were retested using similar test conditions with an increased metal weight of 3.3±6 oz. In each case, the filled and weighted ladle was transferred to the ladle holder and the molten metal splashed onto the fabric. Each fabric was tested using an undergarment consisting of a single layer of all-cotton tee-shirt.

To summarize, the molten metal splash test, molten iron aliquots, at a temperature of approximately 2750° F., are poured onto fabric samples which are disposed at an angle of about 70° from the horizontal. The distance between the source of the molten metal and the fabric sample is approximately twelve inches. The preheated ladle is filled with molten iron from the furnace. The metal weight is determined on a spring balance. The filled ladle is transferred to a holding or pouring ladle and poured onto the fabric. A delay of fifteen seconds between the furnace pour and the ladle pour is used to ensure the constant temperature of the metal. The results of the tests are assessed by visual examination and heat transfer through the sample.

The visual appearance of each experimental fabric was subjectively rated in four categories after being impacted with molten iron. These categories were (1) charring, (2) shrinkage, (3) metal adherence, and (4) perforation. The rating system is outlined in Table I. The char rating describes the extent of scorching, charring, or burning sustained by the fabric. The shrinkage rating provides an indication of the extent of the fabric wrinkling caused by shrinkage occurring around the area of metal impact. It is desirable to have a minimum amount of charring, wrinkling, and shrinkage during or after an impact event.

Metal adherence refers to the amount of metal sticking to the fabric, and the perforation rating describes the extent of fabric destruction in terms of the size and number holes created, and penetration of molten metal through the fabric. It is desirable to have no perforation or penetration of molten metal through the fabric. The rating system uses numbers one through five in each category, with "1" representing the best behavior and "5" representing poor behavior.

Figure 5A:
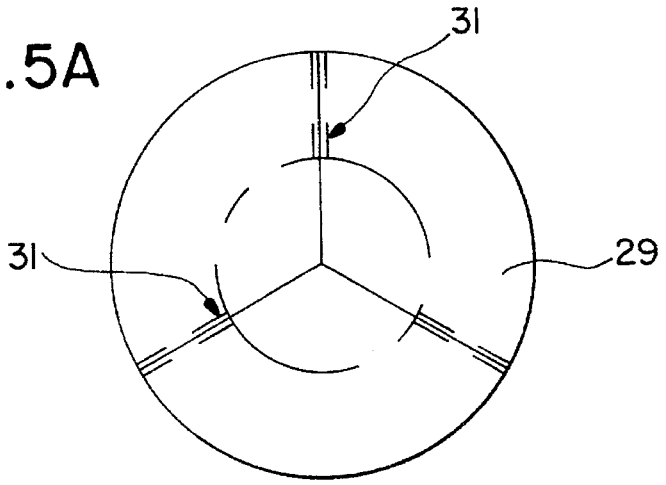
FIG. 5a illustrates a device for measuring the temperature increase through the fabric.
Figure 5B:
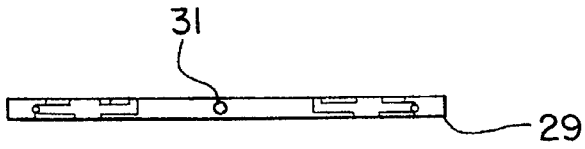
FIG. 5b illustrates a cross section of the device for measuring the temperature increase through the fabric.

The refractory board to which the fabrics were attached was constructed according to ASTM standard (F955-85). The board contained two 1.57 inch diameter, 1/16 inch thick, copper disks. One copper disk was located under the point of molten metal impact, and the second was located four inches below the first. Details of the calorimeter and thermocouple placement are illustrated in FIGS. 3 and 5.

The copper disk calorimeter 29 contained three 32-gauge chromelalumel thermocouples in double bore insulators inserted into radially drilled holes. The averaged thermocouple output from the calorimeter 29, obtained by connecting the three thermocouples in parallel, was recorded with a calibrated strip chart recorder and a desk top computer.

The temperature rise in the calorimeter during and shortly after the splash event was used to calculate the heat flow through the fabric. The heat-flow equation used was:

$$Q = \frac{mCp\Delta T}{A}$$

where

Q=heat flow (cal), m=mass of the calorimeter, (g)

Cp=specific heat of the calorimeter, (cal/g)

ΔT=average temperature rise in calorimeter in the experiments, and

A=surface area of the calorimeter face.

The rate of heat flow through the fabric was calculated by dividing the incremental heat flow ($\Delta Q$) by the time interval ($\Delta t$). A time interval of 0.25 sec was used in data acquisition and in all calculations.

Using the above referenced ASTM procedure, six aluminised fabrics having a 2/2 herringbone twill weave made from core-spun yarn and ranging in weight from 11 to 17 oz/yd2 were compared to evaluate the performance of the melamine fiber fabrics. The primary criteria for determining the fabrics resistance to molten iron splash was the quantity of heat transfer through the fabric and maximum temperature rise in degrees over 30 seconds after the pour. As shown in Table I fabrics containing 35 to 42% melamine fiber performed better than the currently preferred industry fabric containing modacrylic, carbon and kevlor fibers.

Figure 6:
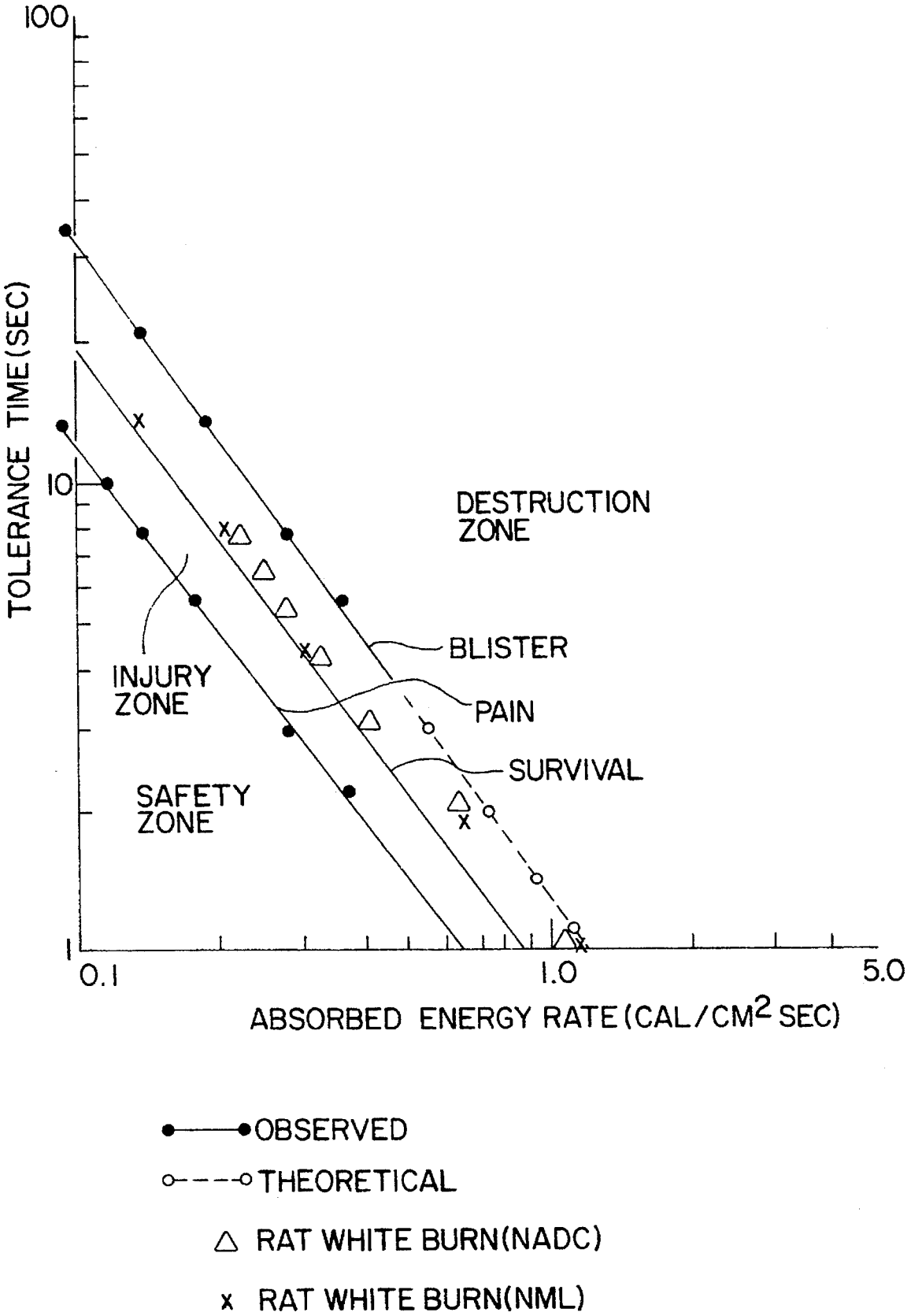
FIG. 6 is a graph depicting energy absorbed vs. injury.

The objective of the molten metal splash evaluations is to provide information on the ability of various fabrics to resist heat transfer under controlled conditions of metal impact. Some literature exists on the damage incurred by unprotected animal and human skin during exposure to radiant heaT. The published results describe the effect of exposure to a rectangular heat pulse of known energy density. Such investigations have led to time-heat flux-burn relationships, as illustrated in FIG. 6. Generally, it is absolutely essential that the heat pulse used be rectangular, for any variation from this shape in thought to invalidate the data. While it is true that a metal splash is an approximately square wave pulse, the skin does not see a rectangular heat pulse because of the filtering effect of protective fabrics. The heat pulse has been damped and skewed by the fabric.

TABLE I

Using 2.2 lb Molten Iron Pour

| FIBER GROUP (%) | SUBSTRATE FABRIC WT OZ/YD$^2$ | ALUMINIZED FABRIC THICKNESS | MAX. TEMP. RISE IN °F. IN 30 SECS. | TOTAL HEAT FLUX THRU THE FABRIC (CAL/CM2SEC) |
|---|---|---|---|---|
| 1. FG(40)*/ Modacrylic (60) | 14 | 0.034" | 102.9 | 3.636 |
| 2. FG(40)Melamine(42)/ Aramid*(18) | 11 | 0.035" | 14.3 | 0.565 |
| 3. FG(40)*/Melamine(42)/ Aramid (18) | 11 | 0.035" | 18.4 | 0.818 |
| 4. Carbon (60)*/ Kevlar(40) | 11 | 0.037" | 17.5 | 0.903 |
| 5. Carbon(74)/ Kevlar(26) | 16 | 0.042" | 20.4 | 0.870 |
| 6. FG(51)*/Melamine(35)/ Aramid(14) | 17 | 0.046" | 17.5 | 0.490 |

*percentage of core yarn

Using the above referenced ASTM procedure, the same six aluminized fabrics having a 2/2 herringbone weave made from core-spun yarn and ranging in weight from 11 to 17 oz/yd2 were compared to further evaluate melamine fiber blend fabrics. As shown in Table II, a 17 oz/yd2 fabric containing 35% melamine fiber out-performed the fabrics made from modacylic, Kevlar and carbon fibers indicating an average heat flux of 0.75 cal/cm2 sec. and a temperature rise of 22.2 degrees.

This difficulty precludes an absolute comparison of fabrics with regard to the amount of skin protection that might be provided during impact conditions. However, it does appear to provide information that may be the basis for a qualitative ranking of fabrics tested under controlled conditions.

In addition to the superior performance illustrated above, melamine fiber have a favorable cost in comparison with other current heat resistant fibers used in this application.

TABLE II

Using a 3.3 lb Molten Iron Pour

| FIBER GROUP (%) | SUBSTRATE FABRIC WT OZ/YD$^2$ | ALUMINIZED FABRIC THICKNESS | MAX. TEMP. RISE IN °F. IN 30 SECS. | TOTAL HEAT FLUX THRU THE FABRIC (CAL/CM2SEC) |
|---|---|---|---|---|
| 1. FG(40)*/ Modacrylic (60) | 14 | 0.034" | 89.3 | 4.367 |
| 2. FG(40)*Melamine(42)/ Aramid(18) | 11 | 0.035" | 25.8 | 1.181 |
| 3. FG(40)*/Melamine(42)/ Aramid (18) | 11 | 0.035" | 24.2 | 1.105 |
| 4. Carbon(60)*/ Kevlar(40) | 11 | 0.037 | 23.7 | 1.392 |
| 5. Carbon(74)*/ Kevlar(26) | 16 | 0.042" | 22.6 | 1.156 |
| 6. FG(51)*/Melamine(35)/ Aramid(14) | 17 | 0.046" | 22.2 | 0.751 |

*percentage of core yarn

Thus, the melamine fiber offers an advantage in fabric cost as shown in Table III below where the melamine price is the base unit.

TABLE III

| FIBER CHEMICAL GROUP | COMMERCIAL PRODUCT | DENIER × STAPLE LENGTH | APPROX. FIBER COST RATIO |
|---|---|---|---|
| 1. Meta-Aramid | NOMEX* or Conex** | 1.5D × 1.5" | 1.92 |
| 2. Para-Aramid | Kevlar*** or Twaron**** | 1.5D × 1.5" | 2.08 |
| 3. Carbon | Celiox***** | Long Staple | 1.67 |
| 4. FR Wool | /irpro****** | 60–64's type | 1.75 |
| 5. Melamine | BASOFIL******* | 2D × 2–3.5" | 1.00 |

*NOMEX . . . TRADEMARK OF DUPONT CO.
**CONEX . . . TRADEMARK OF TEJIN CO.
***KEVLAR . . . TRADEMARK OF DUPONT CO.
****TWARON . . . TRADEMARK OF AKZO CO.
*****CELIOX . . . TRADEMARK OF TOHO CO.
******ZIRPRO . . . TRADEMARK OF WOOL BUREAU CO.
*******BASOFIL . . . TRADEMARK OF BASF CO.

As can be seen from the above, the present invention provides a melamine based composite yarn which has sufficient strength to be woven into a fabric suitable for primary protective applications. In addition, the present invention also permits one to achieve the cost saving available with melamine in a woven fabric of sufficient strength for primary protective clothing.

What I claim is:

1. A weavable, high temperature resistant composite yarn comprised of at least 35% melamine fiber by weight and the balance thereof selected from the group consisting of aramid, polybenzimidazole, phenolic, carbon, flame resistant acrylic and flame resistant cellulosic fibers.

2. The yarn of claim 1 in which said yarn is a core-spun yarn having a core of flame and heat resistant filament yarn and a wrapping about the core consisting of at least 35% of melamine fibers.

3. A textile fabric woven of the yarn defined in claim 1 in which said woven fabric is a herringbone twill weave.

4. A textile fabric woven of the yarn defined in claim 1 in which said fabric has adherent to one face thereof a metallic lamination.

5. The textile fabric of claim 4 in which said metallic lamination is aluminum.

6. The yarn of claim 1 wherein melamine fibers do not comprise more than 70% by weight of the cover.

* * * * *